US008123340B2

(12) United States Patent
Park et al.

(10) Patent No.: US 8,123,340 B2
(45) Date of Patent: Feb. 28, 2012

(54) INK-JET PRINTER

(75) Inventors: Yoon-Sok Park, Suwon-si (KR); Jae-Woo Joung, Suwon-si (KR); Young-Seuck Yoo, Seoul (KR); Suk-Ho Song, Ansan-si (KR); Won-Chul Sim, Seongnam-si (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 340 days.

(21) Appl. No.: 12/435,865

(22) Filed: May 5, 2009

(65) Prior Publication Data

US 2010/0060699 A1 Mar. 11, 2010

(30) Foreign Application Priority Data

Sep. 8, 2008 (KR) ..... 10-2008-0088209

(51) Int. Cl.
*B41J 2/175* (2006.01)
*B41J 2/17* (2006.01)

(52) U.S. Cl. ..... 347/85; 347/84

(58) Field of Classification Search ..... 347/85, 347/84, 86, 92

See application file for complete search history.

(56) References Cited

U.S. PATENT DOCUMENTS

| | | | | |
|---|---|---|---|---|
| 4,527,175 | A * | 7/1985 | Kojima et al. | 347/85 |
| 5,489,925 | A * | 2/1996 | Brooks et al. | 347/6 |
| 5,646,666 | A * | 7/1997 | Cowger et al. | 347/87 |
| 2005/0195254 | A1 * | 9/2005 | Takagi et al. | 347/85 |
| 2006/0044365 | A1 * | 3/2006 | Sonnichsen et al. | 347/84 |
| 2007/0081052 | A1 * | 4/2007 | Lebron et al. | 347/84 |
| 2008/0055378 | A1 * | 3/2008 | Drury et al. | 347/92 |

FOREIGN PATENT DOCUMENTS

| | | | |
|---|---|---|---|
| JP | 2007-175921 | | 7/2007 |
| JP | 2010120375 | A * | 6/2010 |
| KR | 10-2006-0098305 | | 9/2006 |

OTHER PUBLICATIONS

Korean Office Action issued in Korean Patent Application No. 10-2008-0088209, dated Jul. 1, 2010.

* cited by examiner

*Primary Examiner* — Stephen Meier
*Assistant Examiner* — Leonard S Liang
(74) *Attorney, Agent, or Firm* — McDermott Will & Emery LLP

(57) ABSTRACT

Disclosed is an inkjet printer. The inkjet printer in accordance with an embodiment of the present invention includes a supply channel coupled to a plurality of inkjet heads; a first main reservoir and a second main reservoir being coupled to either side of the supply channel; and a first press and a second press applying pressure to the inside of the first main reservoir and the second main reservoir, respectively.

2 Claims, 4 Drawing Sheets

INK-JET PRINTER

CROSS-REFERENCE TO RELATED APPLICATIONS

This application claims the benefit of Korean Patent Application No. 10-2008-0088209, filed with the Korean Intellectual Property Office on Sep. 8, 2008, the disclosure of which is incorporated herein by reference in its entirety.

BACKGROUND

1. Technical Field

The present invention relates to an inkjet printer.

2. Description of the Related Art

An inkjet printer performs printing by converting an electrical signal into a physical force and ejecting ink droplets through a nozzle. Recently, there has been an increase in the density and the number of nozzles formed in the inkjet printer, for the purpose of improving the print quality of the inkjet printer.

With the increased number of nozzles in the inkjet printer, the channel for supplying ink to each inkjet head becomes longer, causing a lengthwise pressure difference in the supply channel.

The pressure difference in the supply channel causes a pressure difference between the inkjet heads coupled to the supply channel and changes the jetting characteristic of each nozzle. Therefore, printing cannot be guaranteed to be uniform, deteriorating the performance of the inkjet printer.

SUMMARY

The present invention provides an inkjet printer having a uniform jetting characteristic among nozzles.

An aspect of the present invention features an inkjet printer. The inkjet printer in accordance with an embodiment of the present invention can include a supply channel coupled to a plurality of inkjet heads; a first main reservoir and a second main reservoir being coupled to either side of the supply channel; and a first press and a second press applying pressure to the inside of the first main reservoir and the second main reservoir, respectively.

Here, the supply channel can be extended lengthwise, and the plurality of inkjet heads can be coupled lengthwise to the supply channel.

DETAILED DESCRIPTION

Figure 1:
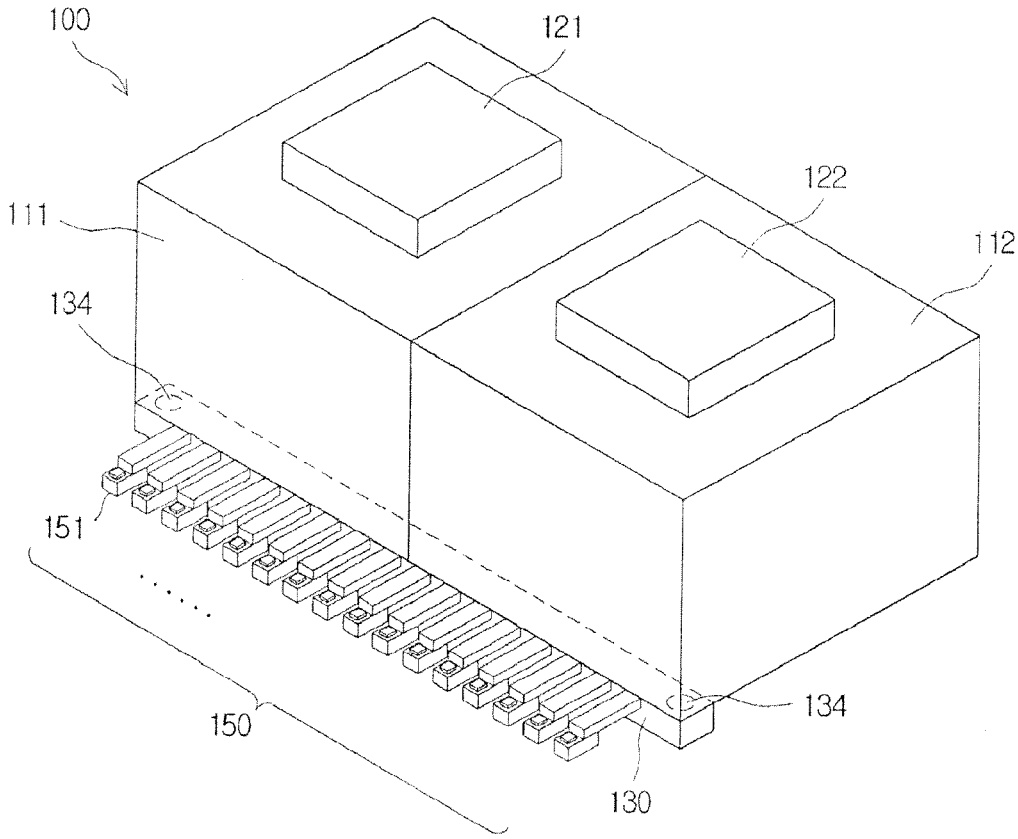
FIG. 1 is a perspective view showing an inkjet printer according to an embodiment of the present invention.

Some of the characteristics and advantages of the present invention will be apparent through the following drawings and detailed description.

Hereinafter, embodiments of an inkjet printer in accordance with the present invention will be described in detail with reference to the accompanying drawings. In description with reference to accompanying drawings, the same reference numerals will be assigned to the same or corresponding elements, and repetitive descriptions thereof will be omitted.

FIG. 1 is a perspective view showing an inkjet printer 100 according to an embodiment of the present invention. As shown in FIG. 1, an inkjet printer 100 according to an embodiment of the present invention includes a supply channel 130 coupled to a plurality of inkjet heads 150, a first main reservoir 111 and a second main reservoir 112, which are joined to either side of the supply channel 130 and a first press 121 and a second press 122, which press the inside of the first main reservoir 111 and the second main reservoirs 112, respectively, thereby improving the print quality by maintaining a uniform jetting characteristic among a multiple number of nozzles 145.

Figure 2:
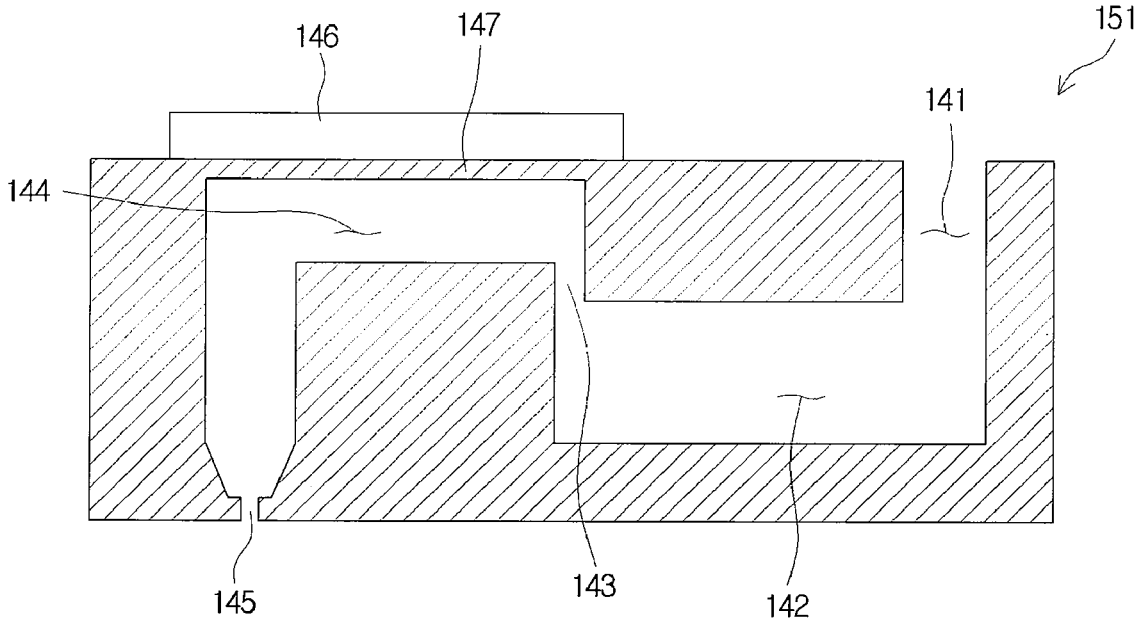
FIG. 2 is a cross-sectional view showing an inkjet head according to an embodiment of the present invention.

FIG. 2 is a cross-sectional view showing an inkjet head 151 according to an embodiment of the present invention. As shown in FIG. 2, an inkjet head 151 can include a reservoir 142, a restrictor 143, a chamber 144, a membrane 147, an actuator 146 and a nozzle 145.

The reservoir 142 accommodates ink and provides the ink to the chamber 144 through the restrictor 143, which will be described below. The reservoir 142 can be supplied with the ink from the supply channel 130 through an inlet port 132, which, as shown in FIG. 1, can be linked to the supply channel through a flow path formed inside a part 131 extended from one side of the supply channel 130.

The reservoir 142 and the chamber 144 are linked to each other through the restrictor 143, which can function as a channel for supplying the ink from the reservoir 142 to the chamber 144. The restrictor 143 is formed to have a smaller cross sectional area than that of the reservoir 142. As a result, if pressure is applied to the chamber 144 by the actuator 146, it is possible to control the flow of the ink supplied from the reservoir 142 to the chamber 144.

The chamber 144 is linked to the restrictor 143 and connected to the reservoir 142. The chamber 144 is linked to the nozzle 145. Through this structure, the inkjet head 151 is supplied with and accommodates the ink from the reservoir 142. By supplying this ink again to the nozzle 145, the ink can be ejected.

One surface of the chamber 144 is covered by the membrane 147. The actuator 146 can be coupled to the upper surface of the membrane 147 that corresponds to the position of the chamber 144.

The actuator 146 is coupled to the upper surface of the membrane that corresponds to the position of the chamber 144 and can generate vibration when electric power is supplied. The actuator 146 transfers the vibration to the membrane, thereby applying pressure to the chamber 144. The actuator 146 can be implemented by various methods, such as a piezoelectric method or an electrostatic method.

The nozzle 145 is linked to the chamber 144 and is supplied with the ink from the chamber 144, and then can perform the function of ejecting the ink. If the vibration generated by the actuator 146 is delivered to the chamber 144, pressure is given to the chamber 144, ejecting the ink through the nozzle 145.

There can be a plurality of inkjet heads 150. Each of the plurality of the inkjet heads 150 can be coupled lengthwise to the supply channel 130, which is extended lengthwise. The supply channel 130 and the reservoir 142 of each inkjet head can be linked to each other through a connecting portion 141.

Figure 3:
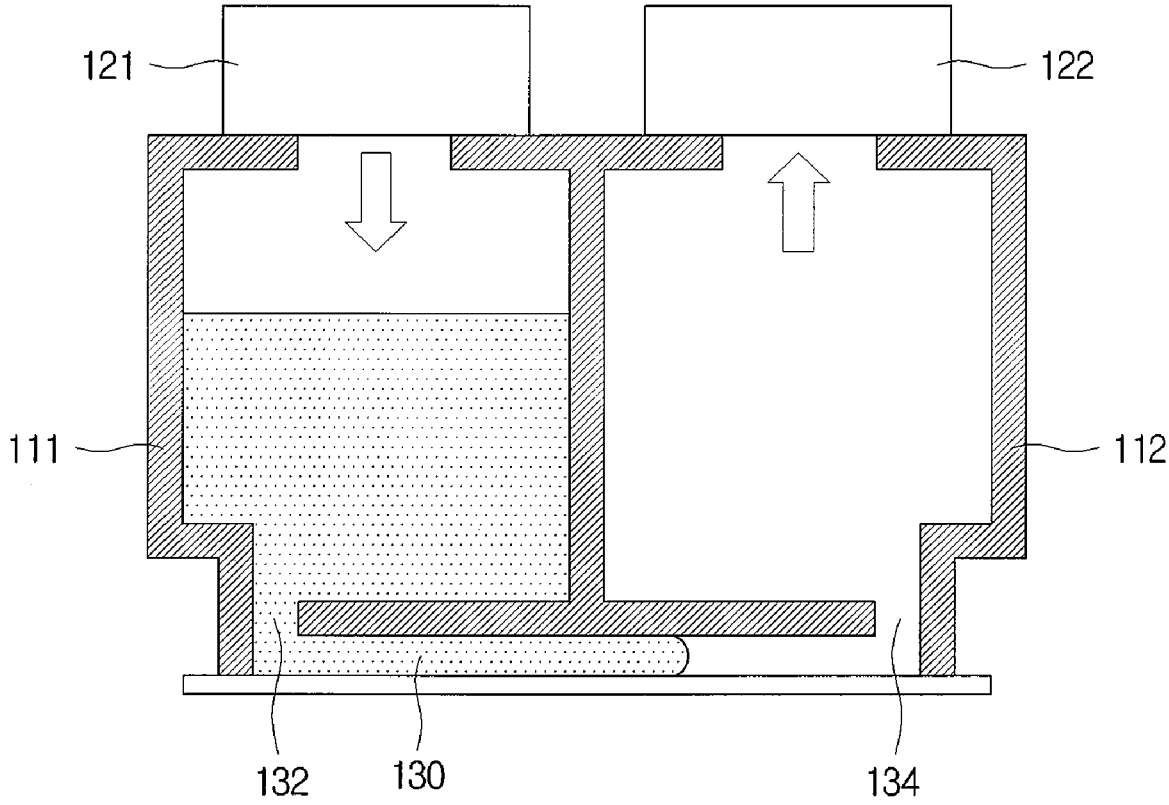
FIGS. 3 and 4 are cross-sectional views showing ink-injection of an inkjet printer according to an embodiment of the present invention.
Figure 4:
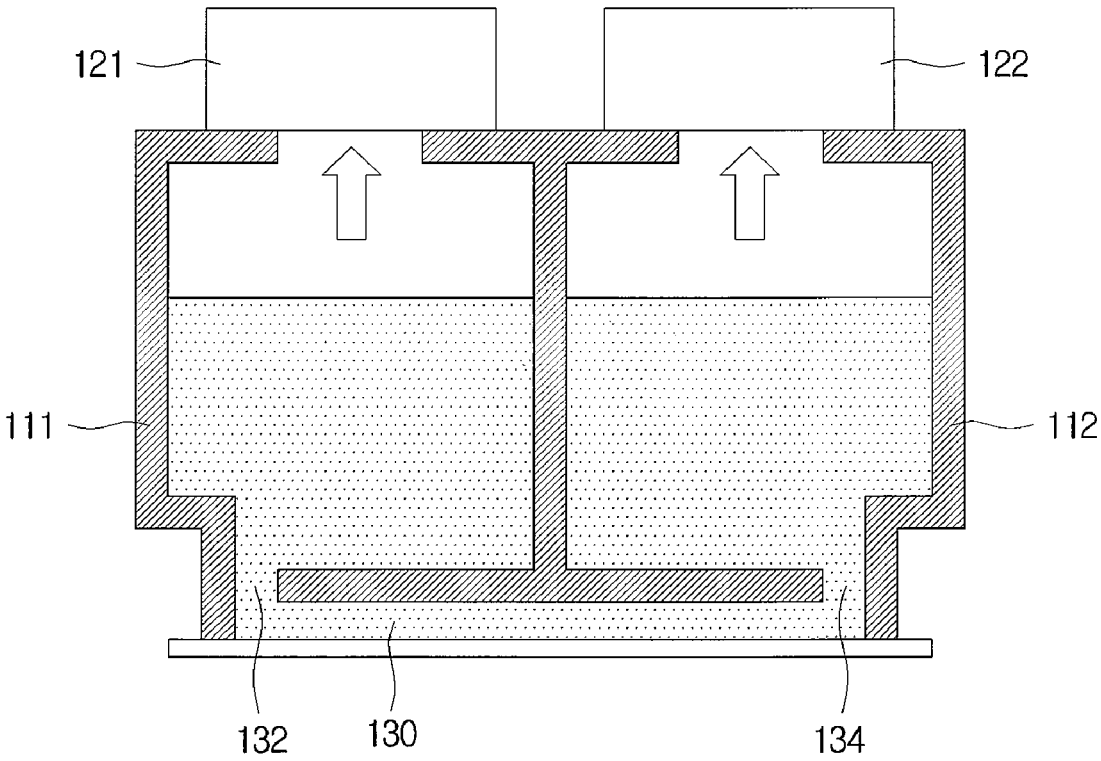

FIGS. 3 and 4 are cross-sectional views showing ink-injection of an inkjet printer 100 according to an embodiment of the present invention. As shown in FIG. 3, the first main reservoir 111 and the second main reservoir 112 can be joined to either side of the supply channel 130. The first main reservoir 111 can be linked to one side of the supply channel 130 through the inlet port 132. The second main reservoir 112 can be linked to the other side of the supply channel 130 through an outlet port 134.

The first main reservoir 111 can accommodate the ink that will be supplied to a plurality of inkjet heads 150. The second main reservoir 112 can accommodate ink that remains after being supplied to the plurality of inkjet heads 150 through the supply channel 130. Therefore, the second main reservoir 112 makes it easier to retrieve the residual ink.

The first press 121 and the second press 122 can press the inside of the first main reservoir 111 and the second main reservoir 112, respectively. The first press 121 and the second press 122 can be joined to the upper part of the first main reservoir 111 and the second main reservoir 112, respectively, and can be linked to the inside of the first main reservoir 111 and the second main reservoir 112, respectively.

The first press 121 and the second press 122 can deliver positive pressure and negative pressure to the inside of the first main reservoir 111 and the second main reservoir 112. The first press 121 and the second press 122 can be, for example, a pneumatic pump, which is capable of generating the positive pressure or negative pressure by rotating in either direction.

As shown in FIG. 3, when the ink is supplied to the plurality of inkjet heads 150 through the supply channel 130, the first press 121 can give the positive pressure to the first main reservoir 111, pushing the ink into the supply channel 130. The second press 122 can give the negative pressure to the second main reservoir 112 and pull the ink supplied into the supply channel 130, making it easier to supply the ink to the plurality of inkjet heads 150. Additionally, bubbles generated insides the supply channel 130 and the plurality of inkjet heads 150 can be minimized.

As shown in FIG. 4, when the supply of ink to the plurality of inkjet heads 150 is completed, the first main reservoir 111 and the second main reservoir 112 can maintain a same ink level. In this case, the first press 121 and the second press 122 can apply negative pressure to the first main reservoir 111 and the second main reservoir 112, respectively, thereby minimizing the lengthwise pressure difference in the supply channel 130 to a minimum.

The first press 121 and the second press 122 can control the pressure applied to the first main reservoir 111 and the second main reservoir 112, respectively, such that the lengthwise pressure difference in the supply channel 130 is minimized. This can minimize the pressure difference among the plurality of inkjet heads 150 and the difference in jetting characteristics of the nozzles 145.

Accordingly, even though a plurality of inkjet heads 150 are coupled to the supply channel 130, uniform jetting characteristics among the nozzles 145 can be obtained by minimizing the pressure difference among the inkjet heads 150, thereby improving the print quality of the inkjet printer 100.

While the present invention has been described with reference to exemplary embodiments thereof, it will be understood by those skilled in the art that various changes and modification in forms and details may be made without departing from the spirit and scope of the present invention as defined by the appended claims.

What is claimed is:

1. An inkjet printer comprising:

a supply channel coupled to a plurality of inkjet heads;

a first main reservoir and a second main reservoir being coupled to either side of the supply channel; and a first press and a second press for applying pressure to the inside of the first main reservoir and the second main reservoir, respectively, wherein:

when ink is supplied to the inkjet heads through the supply channel, the first press applies positive pressure to the first main reservoir, pushing ink into the supply channel, and when the supply of ink to the inkjet heads is completed, the first press and the second press apply negative pressure to the first main reservoir and the second main reservoir.

2. The inkjet printer of claim 1, wherein:

the supply channel is extended lengthwise, and the plurality of inkjet heads are coupled lengthwise to the supply channel.

* * * * *